US009873848B2

(12) United States Patent
Fang et al.

(10) Patent No.: US 9,873,848 B2
(45) **Date of Patent: *Jan. 23, 2018**

(54) FUEL ADDITIVES FOR TREATING INTERNAL DEPOSITS OF FUEL INJECTORS

(71) Applicant: Afton Chemical Corporation, Richmond, VA (US)

(72) Inventors: Xinggao Fang, Midlothian, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 223 days.

This patent is subject to a terminal disclaimer.

(21) Appl. No.: 14/958,974

(22) Filed: Dec. 4, 2015

(65) Prior Publication Data

US 2017/0158977 A1 Jun. 8, 2017

(51) Int. Cl.

| | |
|---|---|
| ***C10L 10/04*** | (2006.01) |
| ***F02B 47/04*** | (2006.01) |
| ***C10L 1/188*** | (2006.01) |

(52) U.S. Cl.

CPC ..... *C10L 10/04* (2013.01); *C10L 1/1883* (2013.01); *F02B 47/04* (2013.01); *C10L 2200/0446* (2013.01); *C10L 2270/026* (2013.01)

(58) Field of Classification Search

CPC ..... C10L 10/04; C10L 1/1883; F02B 47/04
See application file for complete search history.

(56) References Cited

U.S. PATENT DOCUMENTS

| | | | | |
|---|---|---|---|---|
| 4,242,099 | A | 12/1980 | Malec | |
| 4,482,357 | A | 11/1984 | Hanlon | |
| 5,080,686 | A | 1/1992 | Garrecht et al. | |
| 8,475,541 | B2 | 7/2013 | Fang et al. | |
| 8,974,551 | B1 * | 3/2015 | Fang | C10L 1/143 44/347 |
| 2009/0235576 | A1 | 9/2009 | Volkel et al. | |
| 2012/0102826 | A1 | 5/2012 | Fang | |

FOREIGN PATENT DOCUMENTS

| | | | |
|---|---|---|---|
| EP | 0280417 | A1 | 8/1988 |
| EP | 0874039 | A1 | 10/1998 |
| EP | 1669433 | A1 | 6/2006 |
| EP | 1932899 | A1 | 6/2008 |
| GB | 2481278 | | 12/2011 |
| WO | 2011146289 | | 11/2011 |
| WO | 2014137800 | | 9/2014 |
| WO | 2014146928 | A1 | 9/2014 |
| WO | 2015114051 | A1 | 8/2015 |

OTHER PUBLICATIONS

Search and Examination Report for corresponding GB Application No. 1620651.8 dated May 26, 2017.
Search Report and Written Opinion for corresponding BE Application No. 2016000165 dated May 23, 2017 with English translation.
Schwab, S., Bennett, J., Dell, S., Galante-Fox, J. et al., "Internal Injector Deposits in High-Pressure Common Rail Diesel Engines," SAE Int. J. Fuels Lubr. 3(2):865-878, 2010, doi:10.4271/2010-01-2242.
Written Opinion and Search report for corresponding SG Application No. 10201610156X dated Aug. 14, 2017.

* cited by examiner

*Primary Examiner* — Jacob Amick
(74) *Attorney, Agent, or Firm* — Honigman Miller Schwartz and Cohn LLP; Jeffrey A. Chelstrom; Jonathan P. O'Brien

(57) ABSTRACT

Methods for improving the injector performance, unsticking fuel injectors, and reducing an amount of alkali metal carboxylate deposits on internal components of fuel injectors. The method includes operating the diesel engine on a fuel composition comprising a major amount of diesel fuel and from about 45 to about 550 ppm by weight based on a total weight of fuel composition of a fuel additive consisting essentially of a compound of the formula

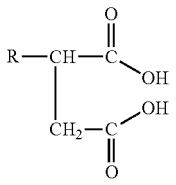

wherein R is an alkyl or alkenyl group containing from 20 to 170 carbon atoms. The additive has a total acid number (TAN) ranging from about 50 to about 290 mg KOH/g. Fuel injectors of the fuel injected diesel engine have an average injector hole diameter of less than 160 μm and an average smallest clearance between injector needle and injector barrel/casing of less than about 10 μm.

15 Claims, No Drawings

FUEL ADDITIVES FOR TREATING INTERNAL DEPOSITS OF FUEL INJECTORS

TECHNICAL FIELD

The disclosure is directed to certain diesel fuel additives and to methods for cleaning and/or preventing internal deposits in injectors for diesel fuel operated engines. In particular, the disclosure is directed to methods that are effective against internal deposits in injectors for engines operating on ultra low sulfur diesel fuels.

BACKGROUND AND SUMMARY

To meet increasingly stringent diesel exhaust emissions requirements, original equipment manufacturers (OEMs) have introduced common rail fuel injection systems that develop pressures of up to 2000 bar (29,000 psi). In addition, fuel delivery schemes have become more complicated, often involving multiple injections per cycle. Fuel injectors using higher pressures and allowing for precise metering of fuel require very tight tolerances within the injector. For example, high pressure fuel injectors may have an average injector hole diameter of less than 160 μm and an average smallest clearance between the injector needle and injector barrel/casing of less than 10 μm. Such designs have made injectors more sensitive to fuel particulate contamination. Accordingly, injector performance concerns run across all segments of diesel engine vehicles including, but not limited to, light-duty diesel passenger vehicles, on-road fleets, mining equipment, farming equipment, railroad, and inland marine engines.

There are two distinct types of deposits that have been identified on fuel injectors. One type of deposit is a hard carbonaceous deposit that is seen on the injector tips and on the outside of the fuel injectors. Such carbonaceous deposit is based on fuel degradation. The other type of deposit is a waxy, white to yellow deposit that appears as a thin film on the internal surfaces of high-pressure common rail (HPCR) injector needles and command plungers, primarily in the lowest clearance areas of the injector internals or on the pilot valve of the injectors.

If left untreated, the internal deposits may lead to significant power loss, reduced fuel economy, and, in extreme cases, increased downtime and higher maintenance costs due to premature replacement of "stuck injectors." The internal deposits are believed to be a result of certain common corrosion inhibitors, biofuel components and acidic friction modifiers, or other carboxylic components used in the fuel interacting with trace amounts of alkali metal salts that form salts that are relatively insoluble in ultra low sulfur diesel (ULSD) fuels compared to the better solubility of such salts in the higher sulfur fuels. The internal deposits may be composed mainly of sodium salts of alkenyl succinic acids. Sodium can enter the diesel fuel from a number of sources including refinery salt drivers, storage tank water bottoms and seawater used as ship ballast. When such salts are present in fuel that is used in a High Pressure Common Rail (HPCR) engines, the salts may tend to deposit in the very tight tolerance areas of the injectors. Such deposits may lead to stuck fuel injectors or poor fuel injection, which in turn may lead to lost power, lost fuel economy, rough running engines, and eventually excessive vehicle downtime and maintenance expense. Many conventional detergents such as succinimide detergents, Mannich detergents and quaternary ammonium salt detergents are not particularly effective at conventional treat rates for removing alkali metal salt deposits from internal components of fuel injectors. Furthermore, the use of such detergents at excessively high treat rates may be detrimental to engine components. Accordingly, there is a continuing need for detergents that are effective for removing internal deposits without detrimentally affecting other engine components.

In accordance with the disclosure, exemplary embodiments provide a method for cleaning up internal components of a fuel injector and for improving injector performance for a diesel engine. The method includes operating the diesel engine on a fuel composition containing (1) a major amount of diesel fuel having a sulfur content of 50 ppm by weight or less and from about 0.1 to 2 ppm by weight of alkali metal as a salt, and (2) from about 45 to about 550 ppm by weight based on a total weight of fuel composition of a fuel additive compound of the formula

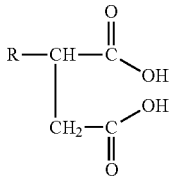

wherein R is an alkyl or alkenyl group containing from 20 to 170 carbon atoms. The additive has a total acid number (TAN) ranging from about 50 to about 290 mg KOH/g. The fuel injectors of the fuel injected diesel engine have an average injector hole diameter of less than 160 μm and an average smallest clearance between injector needle and injector barrel/casing of less than about 10 μm. For example, injector clearance of a DW-10C engine is in the range of from about 2.5 to about 3 μm.

Another embodiment of the disclosure provides a method of unsticking fuel injectors of a fuel injected diesel engine and recovering lost engine power due to the presence of internal injector deposits. The method includes operating the diesel engine on a fuel composition that includes (1) a major amount of diesel fuel having a sulfur content of 50 ppm by weight or less and from about 0.1 to 2 ppm by weight of alkali metal as a salt, and (2) from about 45 to about 550 ppm by weight based on a total weight of fuel composition of a fuel additive consisting essentially of a compound of the formula

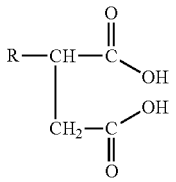

wherein R is an alkyl or alkenyl group containing from 20 to 170 carbon atoms. The additive has a total acid number (TAN) ranging from about 50 to about 290 mg KOH/g. The fuel injectors of the fuel injected diesel engine have an average injector hole diameter of less than 160 μm and an average smallest clearance between injector needle and injector barrel/casing of less than about 10 μm, wherein the fuel injectors are not stuck after clean up, and wherein at least 20% of lost power is recovered in 8 hours according to a DW10 test using a sodium salt as a dopant.

A further embodiment of the disclosure provides a method for reducing an amount of alkali metal salt deposits on internal components of a fuel injector for a fuel injected diesel engine. The method includes operating the diesel engine on a fuel composition comprising (1) a major amount of fuel containing from about 0.1 to 2 ppm by weight of alkali metal as a salt, and (2) from about 45 to about 550 ppm by weight based on a total weight of fuel composition of a fuel additive consisting essentially of a compound of the formula

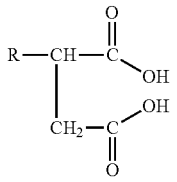

wherein R is an alkyl or alkenyl group containing from 20 to 170 carbon atoms. The additive has a total acid number (TAN) ranging from about 50 to about 290 mg KOH/g. The fuel injectors of the fuel injected diesel engine have an average injector hole diameter of less than 160 μm and an average smallest clearance between injector needle and injector barrel/casing of less than about 10 μm.

An advantage of the fuel additive described herein is that the additive may not only reduce the amount of internal deposits forming on direct and/or indirect diesel fuel injectors, but the additive may also be effective to clean up dirty fuel injectors and restore lost engine power. The unexpected benefits of the fuel additive described herein is quite surprising since much higher treat rates are generally required for conventional detergents to be effective for cleaning up dirty fuel injectors and/or restoring engine power.

Additional embodiments and advantages of the disclosure may be set forth in part in the detailed description which follows, and/or may be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The compositions of the present application that may be used as an additive in a minor amount in a fuel include hydrocarbyl-substituted dicarboxylic acid compounds of the formula

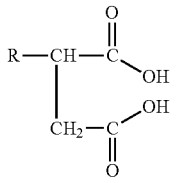

wherein R is a hydrocarbyl group and wherein the additive has a total acid number (TAN) ranging from about 50 to about 290 mg KOH/g, such as from about 80 to about 260 mg KOH/g or from about 120 to about 250 mg KOH/g. The hydrocarbyl group may be an alkyl or alkenyl group containing from 20 to 170 carbon atoms such as from 30 to 70 carbon atoms.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical). In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

"Biorenewable fuels" and "biodiesel fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel may include monohydroxy alcohols, such as those having from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol. Additionally, the fuel may contain from about 0.1 to about 0.2 ppmw metal in the form of salts, such as from about 0.2 to about 1 ppmw or from about 0.4 to about 0.8 ppmw metal in the form of salts based on the total weight of the fuel composition.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As used herein, the term "salts or salt deposits" are understood to mean alkali metal carboxylate salts derived primarily from sodium and potassium, but may include other alkali metal salts. The amount of alkali metal as a salt in the fuel composition may range from about 0.1 to about 2 ppm by weights, such as from about 0.2 to about 1 ppm by weight or from about 0.4 to about 0.8 ppm by weight alkali metal in the form of a carboxylate salt.

The hydrocarbyl-substituted dicarboxylic acid compounds used as fuel additives are selected from compounds of the formula

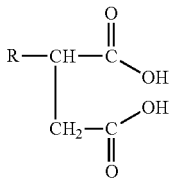

wherein R is a hydrocarbyl group and wherein the additive has a total acid number (TAN) ranging from about 50 to about 290 mg KOH/g. In one embodiment, the TAN of the additive compound ranges from about 80 to about 260 mg KOH/g, or from about 120 to about 260 mg KOH/g, or from about 50 to about 75 mg KOH/g, or from about 50 to about 70 mg KOH/g, such as from about 55 to about 65 mg KOH/g as determined by ASTM D664. The hydrocarbyl group may be an alkyl or alkenyl group containing from 20 to 170 carbon atoms, such as from about 20 to 80 carbon atoms, or from about 30 to 70 carbon atoms. Exemplary hydrocarbyl groups include, but are not limited to linear and branched $C_{20}$ to $C_{50}$—alkyl or alkenyl groups or mixtures of $C_{20}$ to $C_{50}$—alkyl or alkenyl groups, and polyolefinic hydrocarbyl groups derived from ethylene, propylene, isopropylene, butylene, and isobutylene having number average molecular weights in the range of from about 250 to about 2600 Daltons. In one embodiment, the hydrocarbyl group is a polyisobutenyl group having a number average molecular weight ranging from about 400 to about 1000 Daltons.

When formulating the fuel compositions according to the disclosure, the hydrocarbyl-substituted dicarboxylic acid compound described above may be employed in an amount that is sufficient to reduce or inhibit alkali metal carboxylate deposit formation in a diesel engine. In some aspects, the fuels may contain minor amounts of the above described hydrocarbyl-substituted dicarboxylic acid compound that controls or reduces the formation of engine deposits, for example injector deposits in diesel engines. For example, the diesel fuels of this application may contain, on an active ingredient basis, an amount of the hydrocarbyl-substituted dicarboxylic acid compounds in the range of about 45 to about 600 ppm by weight, such as from about 70 to about 550 ppm by weight, or from about 150 to about 500 ppm, or from about 300 to about 450 ppm, or from about 40 to about 300 ppm or from about 50 to about 150 ppm by weight based on a total weight of the fuel composition plus additive. The active ingredient basis excludes the weight of (i) unreacted components associated with and remaining in the product as produced and used, and (ii) solvent(s), if any, used in the manufacture of the hydrocarbyl-substituted dicarboxylic acid compound during or after its formation but before addition of a carrier, if a carrier is employed. Quite unexpectedly, the above described hydrocarbyl-substituted dicarboxylic acid compound is effective in unsticking fuel injectors when used in an amount ranging from about 45 to about 600 ppm by weight based on a total weight of the fuel composition.

In one embodiment, a fuel additive containing the hydrocarbyl-substituted dicarboxylic acid compound described above is substantially devoid of additional detergent compounds including, but not limited to, succinimide compounds, internal salt compounds such as betaine compounds, and the like. In other embodiments, the fuel additive containing the above described hydrocarbyl-substituted dicarboxylic acid compound is substantially devoid of more than 10 ppm by weight of basic nitrogen from nitrogen-containing compounds. That is, the fuel composition may contain less than 10 ppm by weight, such as less than 5 ppm by weight or less than 2 ppm by weight of basic nitrogen from a nitrogen-containing compound without adversely affecting other components of the engine. In other embodiments, the fuel composition and fuel additive may include minor amounts of detergent compounds and nitrogen containing compounds provided the amount of basic nitrogen provided by such compounds does not exceed 10 ppm by weight. In another embodiment, the additive composition may include a minor amount of quaternary ammonium salts.

One or more additional optional compounds may be present in the fuel compositions of the disclosed embodiments. For example, the fuels may contain conventional quantities of cetane improvers, corrosion inhibitors, cold flow improvers (CFPP additive), pour point depressants, solvents, demulsifiers, lubricity additives, friction modifiers, amine stabilizers, combustion improvers, antioxidants, heat stabilizers, conductivity improvers, metal deactivators, marker dyes, organic nitrate ignition accelerators, cyclomatic manganese tricarbonyl compounds, and the like. In some aspects, the fuel compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, N,N'-disalicylidene-1,2-diaminopropane, triazoles, benzotrioles, tolyl triazoles, and the like.

The additives of the present application, including the reaction product described above, and optional additives used in formulating the fuels of this invention may be blended into the base diesel fuel individually or in various sub-combinations. In some embodiments, the additive components of the present application may be blended into the diesel fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels including diesel fuels of the present application may be applicable to the operation of both stationary diesel engines (e.g., engines used in electrical power generation installations, in pumping stations, etc.) and ambulatory diesel engines (e.g., engines used as prime movers in automobiles, trucks, road-grading equipment, military vehicles, etc.). For example, the fuels may include any and all middle distillate fuels, diesel fuels, biorenewable fuels, biodiesel fuel, gas-to-liquid (GTL) fuels, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. The fuels may also contain esters of fatty acids.

Accordingly, aspects of the present application are directed to methods for reducing the amount of alkali metal salt injector deposits of a diesel engine having at least one combustion chamber and one or more direct fuel injectors in fluid connection with the combustion chamber. In another aspect, the improvements may also be observed in indirect diesel fuel injectors. In some aspects, the methods comprise injecting a hydrocarbon-based compression ignition fuel comprising the hydrocarbyl-substituted dicarboxylic compound additive of the present disclosure through the injectors of the diesel engine into the combustion chamber, and igniting the compression ignition fuel. In some aspects, the method may also comprise mixing into the diesel fuel at least one of the optional additional ingredients described above.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

In the following examples, the effect the hydrocarbyl-substituted dicarboxylic acid compounds had on diesel fuel contaminated with alkali metal salts for high pressure common rail diesel fuel systems was evaluated. An engine test was used to demonstrate the propensity of fuels to provoke fuel injector sticking and was also used to demonstrate the ability of certain fuel additives to prevent or reduce the amount of internal deposit in the injectors. An engine dynamometer test stand was used for the installation of the Peugeot DW10 diesel engine for running the injector sticking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The injector performance was then characterized by measuring the cylinder exhaust temperature for each cylinder. A test was stopped and considered to have failed (one or more injectors sticking) if the exhaust temperature of any cylinder was more than 65° C. above any other cylinder exhaust temperature at any point in time. A test was also considered to have stuck injectors if after allowing the engine to cool to ambient temperature, a cold start showed a temperature difference of 40° C. or more in cylinder exhaust temperatures. Sticking of the needle and thus failure could also be confirmed by disassembling the injector and subjectively determining the force required to remove the needle from the nozzle housing.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4000 RPM and full load to check for full power restoration after cleaning the injectors. If the power measurements were within specification, the test cycle was initiated. The following Table 1 provides a representation of the DW10 sticking test cycle that was used to evaluate the fuel additives according to the disclosure.

TABLE 1

One hour representation of DW10 sticking test cycle.

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Injector Sticking Engine Test

Diesel engine nozzle sticking tests were conducted using the Peugeot DW10 engine following the protocol of Table 1. The engine was first run with diesel fuel doped with 0.5 ppm sodium salt as described above without a detergent additive to establish a baseline of stuck fuel injectors. Next, the engine was run with the same fuel containing the detergent additive indicated for 8 hours unless specified otherwise. In all of the tests, the fuels tested contained 200 ppmv lubricity modifier and 1600 ppmv cetane improver, 10 ppmw of dodecenyl succinic acid. At the beginning of the test, no injector sticking was indicated by a uniform exhaust gas temperature for all 4-cylinders. However, a cold start of the engine after 8 hours showed injector sticking for at least one cylinder. The clean-up and injector sticking test results are shown in Table 2.

Comparative Example 1

Quaternary ammonium salt made from polyisobutenylsuccinic anhydride, dimethylaminopropylamine and methyl salicylate.

Comparative Example 2

Commercial quaternary ammonium salt believed to be made from polyisobutenylsuccinic anhydride, dimethylaminopropylamine and propylene oxide.

Comparative Example 3

Ester/acid made from polyisobutenylsuccinic anhydride and dimethylethanol amine.

Comparative Example 4

Reaction product of oleic acid and tetraethylene pentamine in a molar ratio of 2:1.

Comparative Example 5

$C_{18}$-salicylic acid.

Comparative Example 6

950 MW polyisobutenylsuccinic anhydride.

Comparative Example 7

Reaction product of 950 MW polyisobutenylsuccinic anhydride and tetraethylene pentamine in a molar ratio of 1.6:1.

Comparative Example 8

Reaction product of 450 MW polyisobutenylsuccinic anhydride and tetraethylene pentamine in a molar ratio of 2.2:1.

Comparative Example 9

Mono-acid reaction product of 950 MW polyisobutylene substituted succinic anhydride and methyl piperazine, Comparative Example 10

Dodecenylsuccinic acid.

Comparative Example 11

Reaction product of 950 MW polyisobutenylsuccinic anhydride and tetraethylene pentamine in a molar ratio of 1.3:1.

Inventive Example 12

950 MW polyisobutenylsuccinic diacid.

Inventive Example 13

Mixture of $C_{20}$-$C_{24}$ alkenyl succinic diacid.

Inventive Example 14

450 MW polyisobutenylsuccinic diacid

TABLE 2

| Run No. | Additive Used for Clean Up | Additive Treat Rate (active ppm by mass) | Power Change After Base Fuel Dirty Up (%) | Power Change after Additized Fuel Clean Up (%) | Power Recovery after Additized Fuel Clean Up (%) | Injector Sticking After Additized Fuel Clean Up |
|---|---|---|---|---|---|---|
| 1 | Comp. Ex. 2 | 500 | −4.48 | −4.44 | 1 | Yes |
| 2 | Comp. Ex. 7 | 500 | −4.87 | −4.60 | 6 | Yes |
| 3 | Comp. Ex. 7 | 500 | −4.60 | −4.06 | 12 | Yes |
| 4 | Comp. Ex. 8 | 500 | −4.04 | −4.62 | −14 | Yes |
| 5 | Comp. Ex. 9 | 500 | −4.62 | −6.63 | −44 | Yes |
| 6 | Inv. Ex. 12 | 500 | −2.95 | 0.88 | 130 | No |
| 7 | Inv. Ex. 12 | 300 | −4.06 | −1.54 | 62 | No |
| 8 | Inv. Ex. 12 | 300 | −7.92 | −5.05 | 36 | No |
| 9 | Inv. Ex. 13 | 300 | −3.26 | −2.50 | 23 | No |

As shown in Table 2, the hydrocarbyl-substituted dicarboxylic acid additive (Run 6) was significantly more effective for improving power recovery than the conventional additives of Runs 1-5 at a treat rate of 500 ppmw. Even at a lower treat rate of 300 ppmw, the hydrocarbyl-substituted dicarboxylic acid additive (Runs 7-8) was significantly more effective for power recovery than the conventional additives at a treat rate of 500 ppmw. The inventive additives of Runs 6-9 were also effective for unsticking fuel injectors whereas none of the conventional additives were effective for unsticking fuel injectors.

In the following series of tests, the sodium dopant used to dirty up the fuel injectors was from a mixture of 0.5 ppmw sodium (in the form of NaOH) and 10 ppmw dodecenyl succinic acid. The clean-up cycle with the additives was run for 8 hours unless indicated otherwise. All other conditions were the same as in the previous runs. The results are shown in the following Table 3.

TABLE 3

| Run No. | Additive Used for Clean Up | Additive Treat Rate (active ppm by mass) | Power Change After Base Fuel Dirty Up (%) | Power Change after Additized Fuel Clean Up (%) | Power Recovery after Additized Fuel Clean Up (%) | Injector Sticking After Additized Fuel Clean Up |
|---|---|---|---|---|---|---|
| 10 | Comp. Ex. 1 | 500 | −5.62 | −5.29 | 6 | No |
| 11 | Comp. Ex. 2 | 500 | −5.29 | −5.29 | 0 | Yes |
| 12 | Comp. Ex. 3 | 500 | −5.29 | −4.96 | 6 | Yes |
| 13 | Comp. Ex. 4 | 500 | −5.94 | −9.55 | −61 | Yes |

TABLE 3-continued

| Run No. | Additive Used for Clean Up | Additive Treat Rate (active ppm by mass) | Power Change After Base Fuel Dirty Up (%) | Power Change after Additized Fuel Clean Up (%) | Power Recovery after Additized Fuel Clean Up (%) | Injector Sticking After Additized Fuel Clean Up |
|---|---|---|---|---|---|---|
| 14 | Comp. Ex. 5 | 500 | −3.13 | −6.26 | −11 | Yes |
| 15 | Comp. Ex. 6 | 500 | −6.26 | −6.28 | 0 | Yes |
| 16 | Comp. Ex. 10 | 500 | −9.47 | −8.63 | 9 | No |
| 17 | Inv. Ex. 12 (8 hrs) | 500 | −6.79 | −2.72 | 60 | No |
| 18 | Inv. Ex. 12 (16 hrs) | 500 | −6.79 | −1.12 | 84 | No |
| 19 | Inv. Ex. 12 (24 hrs) | 500 | −6.79 | 0.39 | 106 | No |
| 20 | Inv. Ex. 12 (8 hrs) | 500 | −9.55 | −3.13 | 67 | No |
| 21 | Inv. Ex. 14 (8 hrs) | 500 | −4.62 | −0.05 | 89 | No |

As shown by the foregoing runs, the inventive examples of Runs 17-21 were effective for improving power recovery and unsticking fuel injectors, whereas the conventional additives of Runs 10-16 had poorer power recovery and additives of Runs 11-15 were ineffective for unsticking fuel injectors.

In the following examples, an experimental engine test method was used to test fuel propensity to provoke injector deposits (IDID) in direct injection common rail Diesel engines. The test procedure was originally developed by PSA Peugeot Citroen. The engine used for this test method is the PSA DW10-C. The test procedure consists of alternating sequences of soak periods followed by cold starts preceding main run cycles of engine operation. Each main run cycle lasted 6 hours and consisted of a succession of "5 min. /1000 rpm / 10-15 N.m" and "25 min./ 3750 rpm / 110 kW" intervals. The dirty up phase of the engine test used a RF-79 reference fuel doped with 0.5 ppmw sodium in the form as sodium naphthenate and 10 ppmw dodecencyl succinic acid. The Engine was run for 8 hours continuously and the procedure was repeated 5 times. For the clean-up phase of the test, fuel was further mixed with a detergent as indicated in the following table. The propensity of the test fuel to cause injector deposits (IDID) was evaluated using the following criteria:

A. Cold Start Parameters:

1. Number of failed starts.

2. Exhaust temperature deviation from standard value for cylinders 1 to 4

B. Main Run Parameters:

1. Number of engine stalls

2. Number of IDID related ECU faults generated during main run

3. Pedal position drift on low speed phases

4. Injector balancing.

The first cold start of the engine is run with flush fuel and is not rated. A numeric system was used with the above criteria to calculate a score ranging from 0-10 with 10 being a perfect score indicating no problems of internal injector deposit. The results are shown in table 4. The rating system is as follows.

Cold Start (for starts #1 to #5)

First start: merit=5 and each fail start thereafter gets −1 demerit.

Maximum Exhaust Ports Temperature (T) Deviation Rating (for starts #1 to #5):

Merit =5 if T <30° C.; 2 if 30° C. <T<50° C.; and 0 if T>50° C.

Main Run (for runs #1 to #5)

Operability rating:

Merit =5 if no engine stall and no IDID related ECU Fault, each IDID related ECU fault gets "−1" merit discount (after 5th engine clean-up).

Merit =0 if engine stalls (After Next Cold Start).

Maximum Pedal Position (P):

Merit =5 if P is <25%; 2 if 25%<P <40%; 0 if P >40%

Maximum Injector Balancing (IB) Factor deduction:

Merit =5 if IB<20 rpm; 2 if 30 rpm <IB <20 rpm; 0 if IB >30rpm

Main Run Rating range:

Merit =0 to 5 for each Main Run (5 in total)

Maximum global rating value: 75 (ie: 5×10+5×5).

Global rating =10×(Cold Start +Main Run Rating values) / 75 Resulting in 0 to 10 merit scale.

TABLE 4

| Run No. | Total Run hours | Additive Used for Clean Up | Treat rate ppmw | Global Merit Rating |
|---|---|---|---|---|
| 22 | 40 | — | — | 4.7 |
| 23 | 8 | Comp. Ex. 11 | 50 | 4.7 |
| 24 | 32 | — | — | 4.8 |
| 25 | 8 | Comp. Ex. 2 | 50 | 3.3 |
| 27 | 40 | PC10 test fuel | — | 6.8 |
| 28 | 40 | Inv. Ex. 12 | 50 | 10 |

According to Table 4, the inventive additive of Run 28, even at 50 ppm by weight provided a significant improvement in the Global Merit rating compared to Runs 23 and 25 using conventional detergent compounds in the fuel.

As indicated by the foregoing examples, fuel additives containing the hydrocarbyl-substituted dicarboxylic acid compound of the disclosure provides a surprisingly significant reduction in internal alkali metal salt deposits in diesel fuel injectors when engines are operated on ULSD fuels as compared to conventional fuel detergent additives. The foregoing results showed that the detergent additives of the disclosure were significantly more effective for cleaning up dirty fuel injectors than conventional detergents as evidenced by the power recovery shown in Tables 2 and 3.

It is noted that, as used in this specification and the appended claims, the singular forms "a," "an," and "the," include plural referents unless expressly and unequivocally limited to one referent. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method of improving the injector performance of a fuel injected diesel engine comprising operating the diesel engine on a fuel composition comprising (1) a major amount of diesel fuel having a sulfur content of 50 ppm by weight or less and from about 0.1 to 2 ppm by weight of alkali metal as a salt, and (2) from about 45 to about 550 ppm by weight based on a total weight of fuel composition of a fuel additive consisting essentially of a compound of the formula

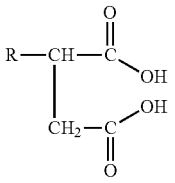

wherein R is an alkyl or alkenyl group containing from 20 to 170 carbon atoms, wherein the additive has a total acid number (TAN) ranging from about 50 to about 290 mg KOH/g, and wherein fuel injectors of the fuel injected diesel engine have an average injector hole diameter of less than 160 μm and an average smallest clearance between injector needle and injector barrel/casing of less than about 10 μm.

2. The method of claim 1, wherein R contains from 30 to 70 carbon atoms.

3. The method of claim 1, wherein the fuel additive comprises less than 10 ppm by weight of basic nitrogen from a nitrogen-containing compound.

4. The method of claim 1, wherein injector performance is improved by removing alkali metal carboxylate internal injector deposits.

5. The method of claim 1, wherein the fuel injected diesel engine comprises a direct fuel injected diesel engine.

6. The method of claim 1, wherein the additive has a TAN ranging from about 100 to about 250 mg KOH/g.

7. A method of unsticking fuel injectors of a fuel injected diesel engine and recovering lost engine power due to the presence of internal injector deposits comprising operating the diesel engine on a fuel composition comprising (1) a major amount of diesel fuel having a sulfur content of 50 ppm by weight or less and from about 0.1 to 2 ppm by weight of alkali metal as a salt, and (2) from about 45 to about 550 ppm by weight based on a total weight of fuel composition of a fuel additive consisting essentially of a compound of the formula

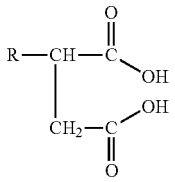

wherein R is an alkyl or alkenyl group containing from 20 to 170 carbon atoms and wherein the additive has a total acid number (TAN) ranging from about 50 to about 290 mg KOH/g, and wherein fuel injectors of the fuel injected diesel engine have an average injector hole diameter of less than 160 μm and an average smallest clearance between injector needle and injector barrel/casing of less than about 10 μm, wherein the fuel injectors are not stuck after clean up, and wherein at least 20% of lost power is recovered in 8 hours according to a DW10 test using a sodium salt as a dopant.

8. The method of claim 7, wherein the fuel injected diesel engine is a direct fuel injected diesel engine.

9. The method of claim 7, wherein R contains from 40 to 80 carbon atoms.

10. The method of claim 7, wherein the alkali metal as a salt comprises a sodium carboxylate salt, and wherein the additive is effective to remove sodium carboxylate salt deposits from internal components of the fuel injectors in a high pressure fuel injection system.

11. A method for reducing an amount of alkali metal salt deposits on internal components of a fuel injector for a fuel injected diesel engine comprising operating the diesel engine on a fuel composition comprising (1) a major amount of fuel containing from about 0.1 to 2 ppm by weight of alkali metal as a salt, and (2) from about 45 to about 550 ppm by weight based on a total weight of fuel composition of a fuel additive consisting essentially of a compound of the formula

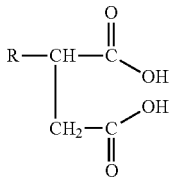

wherein R is an alkyl or alkenyl group containing from 20 to 170 carbon atoms and wherein the additive has a total acid number (TAN) ranging from about 50 to about 290 mg KOH/g, and wherein fuel injectors of the fuel injected diesel engine have an average injector hole diameter of less than 160 μm and an average smallest clearance between injector needle and injector barrel/casing of less than about 10 μm.

12. The method of claim 11, wherein the fuel injected diesel engine is a direct fuel injected diesel engine.

13. The method of claim 11, wherein the fuel is an ultra low sulfur diesel fuel.

14. The method of claim 11, wherein the fuel composition is essentially devoid of succinimide detergent compounds.

15. The method of claim 11, wherein the fuel additive comprises less than 10 ppm by weight of basic nitrogen from a nitrogen-containing compound.

* * * * *